United States Patent [19]

Tucker et al.

[11] Patent Number: 4,710,115

[45] Date of Patent: Dec. 1, 1987

[54] CAGE POSITIONING DEVICE FOR USE WITH A CONCRETE PIPE FORM

[75] Inventors: James L. Tucker; Terry R. Landen; Robert L. Schelby, all of Lincoln, Nebr.

[73] Assignee: Nebco, Inc., Lincoln, Nebr.

[21] Appl. No.: 859,368

[22] Filed: May 5, 1986

[51] Int. Cl.[4] ..... B28B 21/56; B28B 21/26

[52] U.S. Cl. ..... 425/117; 249/64; 249/91; 264/278; 425/262

[58] Field of Search ..... 249/63, 64, 83, 91, 249/93, 117, 145, 151, 176, 205, 11; 425/110, 117, 256, 262, 427, 438; 264/275, 277, 278

[56] References Cited

U.S. PATENT DOCUMENTS

| | | | |
|---|---|---|---|
| 2,181,958 | 12/1939 | Arborio | 249/64 |
| 2,287,858 | 6/1942 | Bespalow | 249/64 |
| 3,262,175 | 7/1966 | Gourlie et al. | 425/117 |
| 3,345,716 | 10/1967 | Uden | 249/151 |
| 3,551,967 | 1/1971 | Williams | 425/117 |
| 3,957,409 | 5/1976 | Grosch | 249/137 |
| 4,151,246 | 4/1979 | Lester et al. | 264/297 |
| 4,505,658 | 3/1985 | Müller | 425/117 |
| 4,519,570 | 5/1985 | Strickland et al. | 249/180 |
| 4,540,539 | 9/1985 | Crawford | 264/269 |

FOREIGN PATENT DOCUMENTS

| | | | |
|---|---|---|---|
| 2756313 | 6/1979 | Fed. Rep. of Germany | 425/117 |
| 590143 | 1/1978 | U.S.S.R. | 425/427 |

*Primary Examiner*—Jay H. Woo
*Assistant Examiner*—James C. Housel
*Attorney, Agent, or Firm*—Zarley, McKee, Thomte, Voorhees & Sease

[57] ABSTRACT

A device is described for positioning a reinforcing cage within a cylindrical concrete pipe form. The device comprises a horizontally movable slide which may be moved inwardly into the form for engagement with the cage. A cam is secured to the slide for moving the slide inwardly and outwardly relative to the form. An air cylinder is pivotally connected to the cam for pivotally moving the cam. An adjustable stop is located in the pivotal path of the cam to limit the inward movement of the slide. A plurality of the devices are mounted on the form in a radially spaced and vertically spaced manner.

10 Claims, 5 Drawing Figures

CAGE POSITIONING DEVICE FOR USE WITH A CONCRETE PIPE FORM

BACKGROUND OF THE INVENTION

Reinforced concrete pipe is conventionally created by positioning a cylindrical reinforcing wire cage within a vertically disposed cylindrical form. Concrete is then introduced into the form by means of a rotating packerhead assembly or other conventional pipe making equipment. A problem associated with the manufacture of reinforced concrete pipe is in centrally positioning the reinforcing wire cage with respect to the form so that the cage will be properly embedded within the pipe and will not be exposed at either the interior or exterior surfaces of the finished concrete pipe.

One method of positioning the cage utilizes spacer elements secured to the cage which extend outwardly therefrom for engagement with the interior of the form. Such a method necessarily results in the outer ends of the spacer elements being exposed at the outer surface of the concrete pipe.

A second method of positioning the cage involves the use of a plurality of horizontally disposed air cylinders which are mounted on the exterior of the form. Each of the air cylinders is connected to a horizontally movable slide which extends into the form for engagement with the cage. Although this method has met with some success, two troublesome disadvantages are associated therewith. The firsts disadvantage is that the forms occupy considerable floor space due to the outwardly extending, horizontally disposed air cylinders. The second disadvantage is that considerable air power is required to fully extend and retract the air cylinder so that the cage engaging slide moves sufficiently into the form for proper engagement with the cage and so that the cage engaging slide will be moved sufficiently outwardly relative to the form when the positioning and pipe forming operations have been completed.

It is therefore a principal object of the invention to provide an improved device for centrally positioning a reinforcing cage within a concrete pipe form.

A further object of the invention is to provide an improved device for positioning a reinforcing cage within a concrete pipe form which occupies less floor space than certain prior art devices.

Yet another object of the invention is to provide a device for positioning a reinforcing cage within a concrete pipe form which does not result in the cage being exposed in the finished product.

Still another object of the invention is to provide a device for positioning a reinforcing cage within a concrete pipe form including a novel cam arrangement for moving a cage positioning slide.

Still another object of the invention is to provide a device for centrally positioning a reinforcing cage within a concrete pipe form which has an adjustment means for limiting the penetration of the cage engaging slides.

These and other objects will be apparent to those skilleld in the art.

SUMMARY OF THE INVENTION

A device is described for positioning a reinforcing wire cage within a concrete pipe form. The positioning device comprises a horizontally movable slide which is moved by a cam pivotally connected to an air cylinder which is angularly disposed with respect to the form.

The inner end of the slide is adapted to engage the exterior of the cage so that the cage will be spaced inwardly from the form in the proper position. An adjustment stop means is provided on the device for selectively limiting the inward movement of the slide. A plurality of the devices are positioned radially around the form and also in a vertically spaced manner.

BRIEF DESCRIPTION OF THE PRFERRED EMBODIMENT

Figure 1:
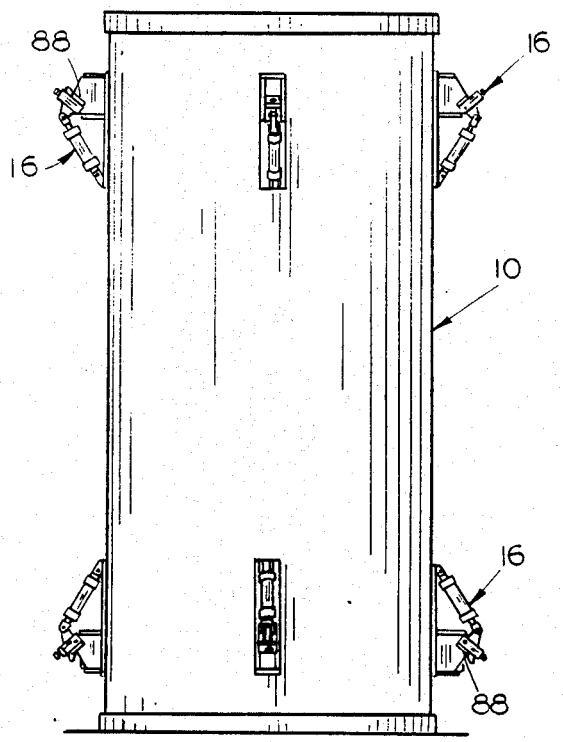
FIG. 1 is a side view of a concrete form having the cage positioning devices of this invention mounted thereon.
Figure 2:
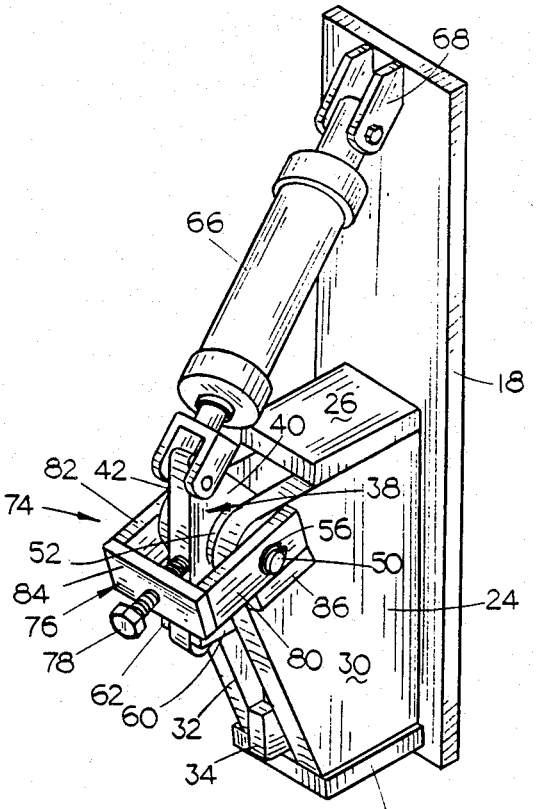
FIG. 2 is a perspective view of the cage positioning device.
Figure 3:
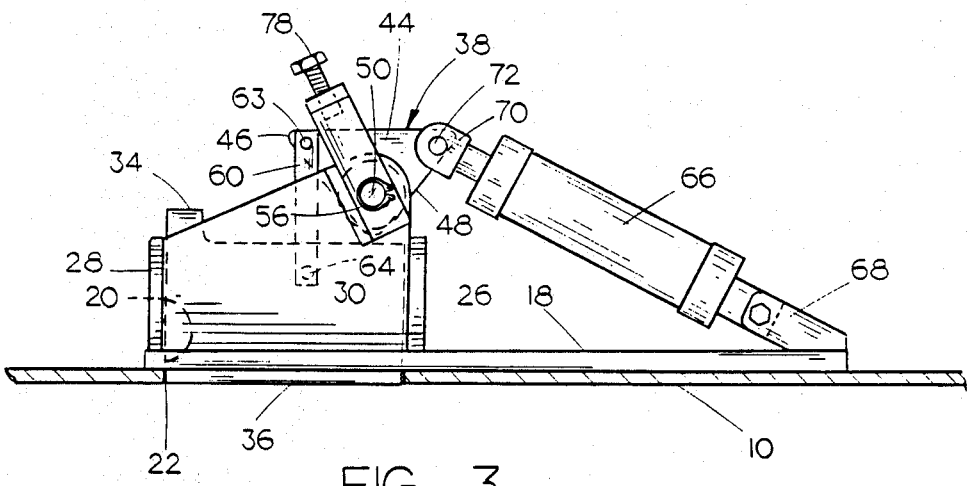
FIG. 3 is a side elevational view of the cage positioning device.
Figure 5:
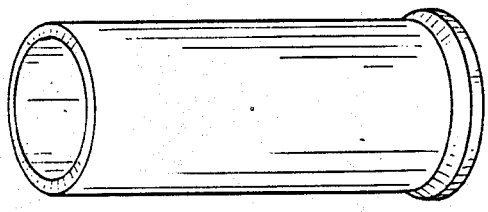
FIG. 5 is a perspective view of a concrete pipe formed by this method.

The numeral 10 refers to a cylindrical concrete pipe form adapted to be used with conventional concrete pipe making devices of the packerhead type. In the drawings, the numeral 12 designates the vertically movable and rotatable packerhead of the concrete type making machine while the numeral 14 refers to the reinforcing cage which is employed in the concrete pipe.

A plurality of cage positioning devices 16 are mounted on the exterior of the form 10 for centering the cage 14 relative to the form 10 and the finished concrete pipe product. Normally, three of four (preferably three) of the cage positioning devices are employed adjacent the lower end of the form in a radially spaced-apart manner and three or four (preferably three) of the cage positioning devices are positioned adjacent the upper end of the form in a similar manner.

Device 16 includes a base plate 18 which is welded to the exterior of the form 10. Base plate 18 is provided with a rectangular opening 20 formed therein which communicates with a rectangular opening 22 in form 10. A guide frame 24 is secured to the lower end of base plate 18 and is positioned around the opening 20 as seen in the drawings. Form 24 includes spaced-apart upper and lower walls 26 and 28, and opposite side walls 30 and 32. Slide 34 is slidably mounted in guide frame 24 and includes an inner end 36 which extends through opoening 20 and which is adapted to be extended through opening 22 for engagement with the cage 14 to center the same relative to the form.

A flat triangular shaped cam 38 including opposite sides 40 and 42, and edge portions 44, 46 and 48 is pivotally connected to side walls 30 and 32 of guide frame 24 by means of pin 50. Bushing 52 is mounted on pin 50 between side wall 30 and cam 38. Similarly, bushing 54 is mounted on pin 50 between side wall 32 and cam 38. Retaining rings 56 and 58 are removably mounted on the outer ends of pin 50 to maintain pin 50 in place. As will be described hereinafter, the retaining pins 56 and 58 also maintain a depth adjustment means 84 on pin 50.

A pair of connecting rods 60 and 62 are pivotally secured, at one end thereof, to cam 38 by pin 63. The inner ends of connecting rods 60 and 62 are pivotally secured to slide 34 by means of pin 64.

An air cylinder 66 is pivotally connected at its base end to bracket 68 which is secured to the upper end of base plate 18. The rod end 70 of cylinder 66 is pivotally connected to cam 38 by means of pin 72.

A depth adjustment means 74 is mounted on pin 50 as seen in the drawings and includes a U-shaped frame means 76 having an adjustment screw 78 threadably mounted therein. For purposes of descripton, frame means 76 will be described as including side frame members 80 and 82 having frame member 84 extending therebetween at the outer ends thereof. As seen in the drawings, screw 78 threadably extends through frame member 84. Stops 86 and 88 are welded to the outer surfaces of side walls 30 and 32 to limit the movement of side frame members 80 and 82 in one direction. As seen in the drawings, the inner end of screw 78 is in the pivotal path of edge portion 44 of cam 38 to limit the amount that cam 38 may pivot, in one direction, which limits the inward movement of slide 34 relative to form 10.

In operation, the cage 14 is positioned within the form 10 and all of the hydraulic cylinders on the cage positioning devices 16 are extended or actuated. Actuation of the cylinder 66 causes cam 38 to pivotally move so that connecting rods 60 and 62 move slide 34 inwardly through opening 22 in form 10 for engagement with the cage 14. Thus, the three devices 16 at the lower end of the form 10 centrally position the lower end of the cage 14 relative to the form 10 and the three devices 16 at the upper end of the form 10 centrally position the upper end of the cage 14 relative to the form 10. Adjustment screw 78 may be threadably moved relative to frame member 84 to limit the amount of inward movement of the slide 34 as previously described.

Figure 4:
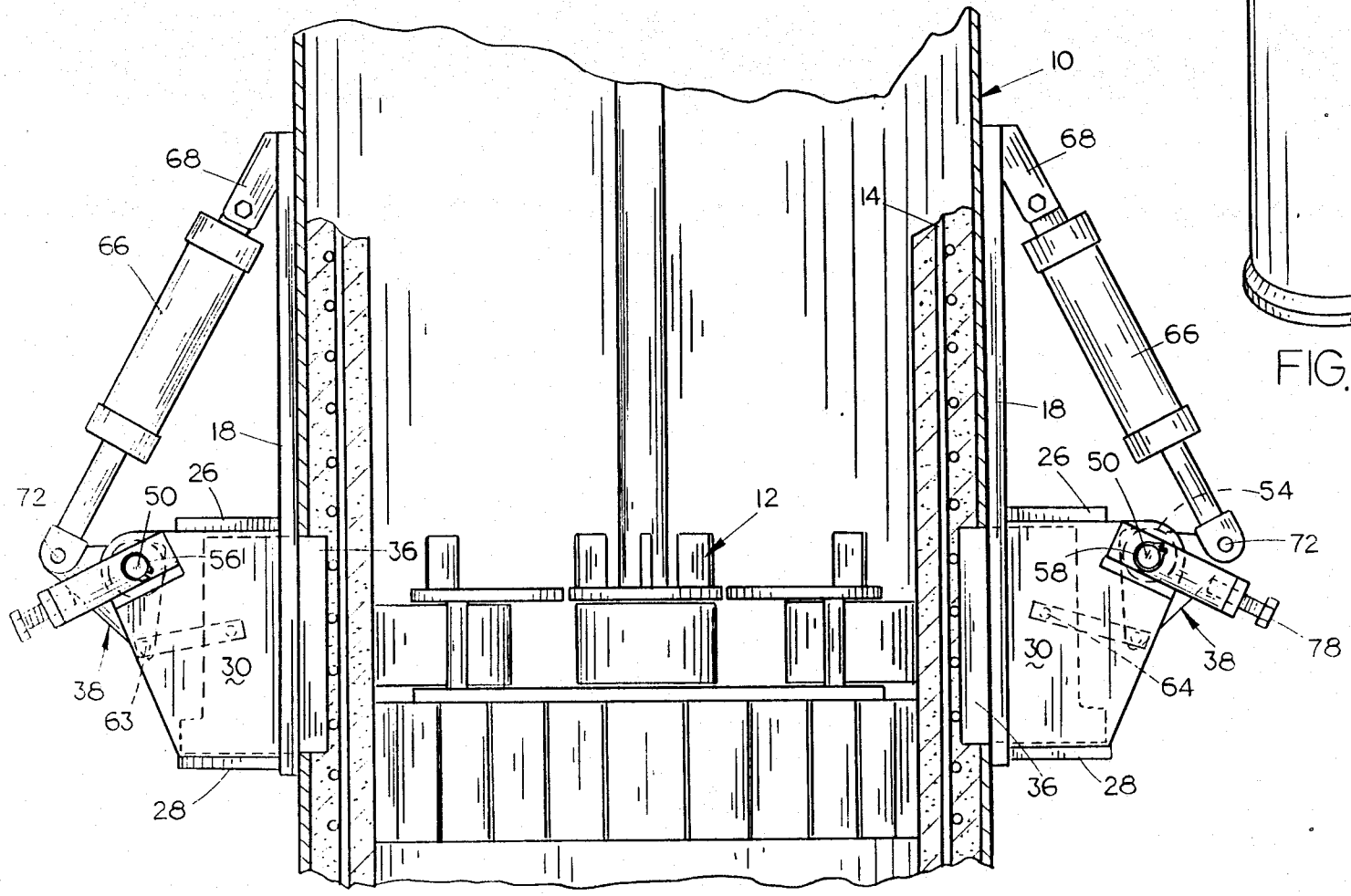
FIG. 4 is a sectional view illustrating the relationship of the cage positioning devices, form and packerhead assembly.

When the cage has been positioned, the packerhead assembly is lowered into the lowermost portion of the form 10 and is operated in conventional fashion to create the concrete pipe as the packerhead moves upwardly relative to the form. When the packerhead is approximately 4 to 6 inches below the inner ends of the lowermost slides 34, the air cylinders 66, on the lower set of devices 16 are retracted so that the inner ends 36 of the slides 34 will not interfere with the pipe forming operation and so that voids will not appear in the exterior surface of the pipe. It should be noted that FIG. 4 illustrates the slides 34 in their cage engaging positions even through the packerhead assembly is "higher" than the 4 to 6 inches just described. The packerhead continues to move upwadly relative to the form and the slides 34 on the devices 16 at the upper end of the form are not retracted until the packerhead assembly is approximaely 4 to 6 inches below the inner ends 36 of the slides 34. At that time, the air cylinders 66 are retracted to withdraw the slides 34.

Thus it can be seen that a novel cage positioning device has been provided for use with a form for concrete pipe which does not require as much floor space as conventional prior art devices since the air cylinders are angularly disposed. It can also be seen that the unique relationship of the air cylinder 66, cam 38 and slide 34 results in sufficient movement of the slide 34 without excessive movement of the rods of the air cylinder thereby conserving air power.

Thus it can be seen that the invention accomplishes at least all of its stated objectives.

We claim:

1. In combination, a hollow cylindrical concrete pipe form having upper and lower ends, and inner and outer wall surfaces, said form being adapted to receive a cylindrical reinforcing cage means therein which will be embedded in the concrete pipe formed in said form, and a plurality of cage positioning devices mounted on the outer wall surface of said form, each of said cage positioning devices comprising a vertically disposed guide frame means having a horizontally slidable slide member mounted therein adapted to be moved between operative and inoperative positions, said slide member having inner and outer ends, the inner end of said slide member being moved inwardly through an opening formed in the form, for engagement with the reinforcing cage, when in its operative position, a cam means pivotally mounted on said guide frame means in operative engagement with said slide for moving said slide relative to said guide frame means, said cam means movable along a pivotal path, means located in said pivotal path for limiting the pivotal movement of said cam means to limit the inward movement of said slide, a power cylinder including a base end and a rod end, said base end of said power cylinder being operatively secured to said form above said cam means, and means pivotally connecting the rod end of said power cylinder to said cam means whereby extension of said power cylinder will cause pivotal movement of said cam means which causes said slide to be moved inwardly into said form.

2. In combination, a hollow cylindrical concrete pipe form having upper and lower ends, and inner and outer wall surfaces, said form being adapted to receive a cylindrical reinforcing cage means therein which will be embedded in the concrete pipe formed in said form, and a plurality of cage positioning devices mounted on the outer wall surface of said form, each of said cage positioning devices comprising a vertically disposed guide frame means having a horizontally slidable slide member mounted therein adapted to be moved between operative and inoperative positions, said slide member having inner and outer ends, the inner end of said slide member being moved inwardly through an opening formed in the form, for engagement with the reinforcing cage, when in its operative position, a cam means pivotally mounted on said guide frame means in operative engagement with said slide for moving said slide relative to said guide frame means, said cam means pivotable along a pivotal path, a power cylinder including a base end and a rod end, said base end of said power cylinder being operatively secured to said form above said cam means, means pivotally connecting the rod end of said power cylinder to said cam means whereby extension of said power cylinder will cause pivotal movement of said cam means which causes said slide to be moved inwardly into said form, and a depth stop means secured to said guide frame means which is in the pivotal path of said cam means to limit the pivotal movement of said cam means and the inward movement of said slide.

3. The combination of claim 2 wherein said cam means is comprised of a flat, triangular shaped plate.

4. The combination of claim 2 wherein said depth stop means is adjustable.

5. The combination of claim 2 wherein said power cylinder is an air cylinder.

6. The combination of claim 2 wherein said cage positioning device includes a base plate secured to the outer wall surface of said form, said power cylinder and said guide frame means being mounted on said base plate.

7. A reinforcing cage positioning device for use on a vertically disposed hollow cylindrical concrete pipe form having a reinforcing cage positioned therein, said form having a plurality of vertically disposed, rectangular openings formed therein, comprising, said reinforcing cage positioning device adapted to be secured to the exterior of said form adjacent the rectangular openings formed therein, each of said cage positioning devices comprising a vertically disposed guide frame means having a horizontally slidable slide member mounted therein adapted to be moved between operative and inoperative positions, and slide member having inner and outer ends, the inner end of said slide member being moved inwardly through an opening formed in the form, for engagement with the reinforcing cage, when in its operative position, a cam means pivotally mounted on said guide frame means in operative engagement with said slide for moving said slide relative to said guide frame means, said cam means pivotable along a pivotal path, means located in said pivotal path for limiting pivotal movement of said cam means to limit the inward movement of said slide, a power cylinder, including a base end and a rod end, said base end of said power cylinder being operatively secured to said form above said cam means, and means pivotally connecting the rod end of said power cylinder to said cam means whereby extension of said power cylinder will cause pivotal movement of said cam means which causes said slide to be moved inwardly into said form.

8. A reinforcing cage positioning device for use on a vertically disposed hollow cylindrical concrete pipe form having a reinforcing cage positioned therein, said form having a plurality of vertically diposed, rectangular openings formed therein, comprising, said reinforcing cage positioning device adapted to be secured to the exterior of said form adjacent the rectangular openings formed therein, each of said cage positioning devices comprising a vertically disposed guide frame means having a horizontally slidable slide member mounted therein adapted to be moved between operative and inoperative positions, said slide member having inner and outer ends, the inner end of said slide member being moved inwardly through an opening formed in the form, for engagement with the reinforcing cage, when in its operative position, each of said cage positioning devices comprising a vertically disposed guide frame means having a horizontally slidable slide member mounted therein adapted to be moved between operative and inoperative positions, said slide member having inner and outer ends, the inner end of said slide member being moved inwardly through an opening formed in the form, for engagement with the reinforcing cage, when in its operative position, a cam means pivotally mounted on said guide frame means in operative engagement with said slide for moving said slide relative to said guide frame means, said cam means movable along a pivotal path, a power cylinder including a base end and a rod end, said base end of said power cylinder being operatively secured to said form above said cam means, means pivotally connecting the rod end of said power cylinder to said cam means whereby extension of said power cylinder will cause pivotal movement of said cam means which causes said slide to be moved inwardly into said form, and a depth stop means secured to said guide frame means which is in the pivotal path of said cam means to limit the pivotal movement of said cam means and the inward movement of said slide.

9. The combination of claim 8 wherein said depth stop means is adjustable.

10. The combination of claim 8 wherein said power cylinder is an air cylinder.

* * * * *